US007498906B2

(12) United States Patent
Pirard

(10) Patent No.: US 7,498,906 B2
(45) Date of Patent: Mar. 3, 2009

(54) RADIATING COAXIAL CABLE HAVING SPACED PERIODIC APERTURE ARRAYS

(75) Inventor: Willy Pirard, Neupré (BE)

(73) Assignee: Institut Scientifique de Service Public, Liege (BE)

( * ) Notice: Subject to any disclaimer, the term of this patent is extended or adjusted under 35 U.S.C. 154(b) by 260 days.

(21) Appl. No.: 11/426,507

(22) Filed: Jun. 26, 2006

(65) Prior Publication Data

US 2007/0001788 A1 Jan. 4, 2007

(30) Foreign Application Priority Data

Jun. 30, 2005 (EP) ..... 05105959
Feb. 15, 2006 (EP) ..... 06101720

(51) Int. Cl.
*H01Q 13/20* (2006.01)

(52) U.S. Cl. ..... 333/237; 343/770

(58) Field of Classification Search ..... 333/237; 343/770

See application file for complete search history.

(56) References Cited

U.S. PATENT DOCUMENTS

| | | | | |
|---|---|---|---|---|
| 3,795,915 | A * | 3/1974 | Yoshida | 343/771 |
| 4,152,648 | A | 5/1979 | Delonge | |
| 4,322,699 | A | 3/1982 | Hildebrand et al. | |
| 5,276,413 | A * | 1/1994 | Schulze-Buxloh | 333/237 |
| 5,291,164 | A | 3/1994 | Levisse | |
| 5,705,967 | A | 1/1998 | Pirard et al. | |
| 6,246,005 | B1 | 6/2001 | Mahlandt et al. | |
| 6,292,071 | B1 | 9/2001 | Taniguchi | |
| 6,292,072 | B1 | 9/2001 | Bode et al. | |
| 2001/0054945 | A1 | 12/2001 | Mahlandt et al. | |

FOREIGN PATENT DOCUMENTS

| | | |
|---|---|---|
| BE | 1010528 | 10/1998 |
| DE | 28 12 523 | 9/1979 |

(Continued)

OTHER PUBLICATIONS

Wang et al.; Theory and Analysis of Leaky Coaxial Cables with Periodic Slots; IEEE Transactions on Antennas and Propagation; Dec. 2001; pp. 1723-1732; vol. 49, No. 12.

*Primary Examiner*—Benny T. Lee
(74) *Attorney, Agent, or Firm*—Jason Bernstein; Bryan Cave LLP

(57) ABSTRACT

A radiated mode coaxial cable comprising an outer conductor provided with a periodic aperture array, comprising a plurality (n) of apertures or aperture sets, repeated along the length of said outer conductor whereas a constant spacing s separates the left end of the first aperture of one array and the left end of the first aperture of a next array, wherein each array comprises at least 10 apertures or aperture sets, whereas the global length L (in mm) of the apertures or aperture sets is larger than $(10D/n)^{1/2}$ where D is the diameter of the cable (in mm) and whereas the aperture spacing (d) in between two successive apertures or aperture sets is larger than 1.5w where w is the aperture width in the cable axis direction, and wherein the spacing s between two successive aperture arrays is selected so that $\lambda_{opt.1}/(\sqrt{\epsilon_r}-0{,}866)<s<\lambda_{opt.2}/(\sqrt{\epsilon_r}-1)$, where $\lambda_{opt.1}$ and $\lambda_{opt.2}$ are respectively the upper and lower limits of the optimal wavelength range the radiated mode coaxial cable is designed for and where $\epsilon_r$ represents the relative dielectric constant of the radiating cable.

5 Claims, 4 Drawing Sheets

FOREIGN PATENT DOCUMENTS

| | | | |
|---|---|---|---|
| DE | 2 812 512 | | 10/1979 |
| DE | 9 318 420 | | 1/1994 |
| EP | 0 765 002 | A2 | 3/1997 |
| FR | 2 685 549 | | 6/1993 |
| GB | 1 387 001 | A | 3/1975 |
| GB | 1 481 485 | | 7/1977 |
| JP | 2003273641 | | 9/2003 |
| WO | WO99/17401 | | 4/1999 |

* cited by examiner

RADIATING COAXIAL CABLE HAVING SPACED PERIODIC APERTURE ARRAYS

FIELD OF THE INVENTION

The present invention relates generally to a radiating coaxial cable, and more particularly, to a radiating coaxial cable having equally-spaced groups of apertures for generating electromagnetic waves.

Radiating coaxial cables are particularly appropriate to allow radio communication links with mobile equipment in indoor environments such as tunnels, mines, underground railways and buildings.

BACKGROUND OF THE INVENTION

The use of radiating coaxial cables in these environments is particularly important as a result of the development of mobile communication systems (radio links, cellular phone, cordless telephone, wireless computer network, etc.).

Nowadays, these mobile communications systems operate in a very large spectrum the frequencies of which are allocated at an international level. Starting from the low frequencies, the bands are allocated as follows (these figures are only indicative and may vary according to countries):

74 to 87 MHz: Private mobile radio;

88 to 108 MHz: FM radio broadcast;

145 to 175 MHz: Private mobile radio;

around 225 MHz: Digital Audio Broadcast (DAB);

380 to 470 MHz: Private mobile radio and TETRA networks;

824 to 894 MHz: TDMA IS-54 and CDMA IS 95 mobile networks;

870 to 960 MHz: GSM 900, GSM R and TETRA mobile communication networks;

1710 to 1880 MHz: GSM 1800 networks;

1885 to 2200 MHz: UMTS networks.

Moreover, such radiating coaxial cables can also be used in outdoor or indoor environments to restrict the radio coverage in a narrow lateral corridor along an axis, e.g. a transport route, a railway, a defined path in a workshop, etc. Restricting the radio coverage in a certain width may be required to avoid interference with neighbouring transmitters operating at the same radio frequency.

Various types of radiating cables are known; they consist of a coaxial cable comprising an inner conductor surrounded by a dielectric and an outer conductor of tubular form. The outer conductor includes apertures which generate an electromagnetic radiation. The outer conductor is covered by an insulating outer sheath.

The apertures in the outer conductor may be of various types, for example a longitudinal slot over the entire length of the cable, or numerous small holes very close to each other. There also exist cables in which the outer conductor consists of a loose braiding, or sometimes of a layer of wires wound in a spiral around the dielectric. The common characteristic of these cables is that the total length of the outer conductor includes apertures separated by a distance considerably shorter than the wavelength of the radiated signal. All these cables operate in a mode known as "coupled mode" and the radiated energy propagates in a direction parallel to the cable. With these cables, the signal received by a receiving antenna falls off rapidly when the distance between the antenna and the cable increases. Moreover, the received signal fluctuates greatly when the receiving antenna is moved along a path parallel to the cable.

A more recent technique has proposed cables known as "radiated mode cables" in which the outer conductor includes groups of apertures, which are reproduced with a constant spacing s, this spacing being of the same order of magnitude as the wavelength of the signal to be radiated. The radiation produced by the radiated mode cables propagates in a radial direction (FIG. 1), forming an angle $\theta_1$ with the cable axis lying between 0° and 180°.

It is known by those skilled in the art that a radiated mode cable produces a main mode which propagates in a direction forming an angle $\theta_1$ with the axis of the cable; this angle is given by the formula:

$$\theta_1=\arccos\{\lambda/s-\sqrt{\epsilon_r}\} \tag{1}$$

where:

s: aperture group spacing (in meters);

$\lambda$: signal wavelength in the air (in meters);

$\epsilon_r$: relative dielectric constant of the cable (coefficient).

It may be noted here that for practical purposes the expression wavelength "in the air" and wavelength "in free space" can be considered as synonyms.

In the above expression, the direction of reference for measuring $\theta_1$ is the direction of the cable end fed by the radio frequency generator, as illustrated in FIG. 1.

A radiated mode cable operates in this way in a band from $\lambda_{start}$ to $\lambda_{end}$ where $\lambda_{start}$ and $\lambda_{end}$ correspond to $\theta_1=0°$ and 180° respectively. These wavelengths (in the air) $\lambda_{start}$ and $\lambda_{end}$ are linked respectively to the frequencies $f_{start}$ and $f_{end}$ (in MHz) by $$f_{start}=\frac{300}{\lambda_{start}} \tag{2}$$

$$f_{end}=\frac{300}{\lambda_{end}} \tag{3}$$

It is known by those skilled in the art that the ratio $f_{end}/f_{start}$ is given by $$f_{end}/f_{start}=\frac{\sqrt{\varepsilon_r}+1}{\sqrt{\varepsilon_r}-1} \tag{4}$$

With the dielectric usually used between the inner and outer conductors, $\sqrt{\epsilon_r}$ is generally lying between ≅1.1 and ≅1.15. Consequently, $f_{end}/f_{start}$ varies between ≅14 and ≅21.

Hereinafter most calculations are carried out with $\sqrt{\epsilon_r}=1.136$ which is the most frequent value with dielectrics presently used. It should be stressed, however, that the conclusions which will be drawn will generally also be valid if $\sqrt{\epsilon_r}$ is not equal to this particular value.

FIG. 1 shows the graph of $\theta_1$ versus $f/f_{start}$ calculated for $\sqrt{\epsilon_r}=1.136$. This figure shows that $\theta_1$ begins at 0° when f is equal to $f_{start}$. Then, $\theta_1$ increases with f up to 180° (degrees from 0 to 180 are shown in FIG. 1 on the inner part of the curve) when $f=f_{end}$ which is equal to 15.71 $f_{start}$ (1 to 15.71 are shown in increments in FIG. 1 on the outer part of the curve). Below $f_{start}$ and above $f_{end}$, the cable operates in coupled mode.

Compared to coupled mode cables, the main advantages of the radiated mode cables are:

a lower coupling loss;

a coupling loss which increases less rapidly in the radial direction;

a field which fluctuates less when moving parallel to the axis of the cable.

However, it is also known by those skilled in the art that the third advantage above disappears when the frequency reaches $2f_{start}$ if some precautions are not adopted since there appears a second order mode which propagates in a direction $\theta_2$ different from $\theta_1$ and which interferes with the main mode. According to the relation (1), $\theta_1 \cong 94°$ (for $\sqrt{\epsilon_r}=1.136$) when $f=2f_{start}$. If f continues to increase, a third mode appears when $f=3f_{start}$ and so on for all the $f_{start}$ multiples. As a consequence, the higher the frequency, the more numerous are the secondary modes which all propagate in different directions $\theta_i$. These interferences between the main and secondary modes result in rather large field strength fluctuations along the cable.

If we consider first the case of narrow band radiating cables, i.e., the cables used at only one or several frequencies very close to each other (this is the case if the cable is only used for one radio communication application listed above), prior art cables were generally designed to have the $\theta_1$ angle very close to 90° in the frequency band for which the cable is intended. The main reasons are avoiding the secondary mode which appears for $\theta_1$ higher than about 94° and also because, with most aperture types, the radiation decreases in the directions nearly parallel to the cable axis (i.e., with $\theta_1$ close to 0° or 180°).

Formula (1) indicates that choosing a spacing $s \cong \lambda$ gives rise to $\theta_1 \cong 90°$ as $\sqrt{\epsilon_r} \cong 1$. This is the reason why prior art narrow band radiating cables are designed with the aperture group spacing approximately equal to the wavelength (in the air) for which the cable is intended.

FIG. 2 illustrates a specific exemplary embodiment of such prior art narrow band radiating cables; in this exemplary embodiment, each aperture group includes two slots slanted in opposite directions and the group spacing is approximately equal to the wavelength $\lambda$.

If we consider now the case of wide band radiating cables, i.e., cables which must feature satisfactory performances in the frequency band allocated to several mobile communication applications, the main problem to solve is the field fluctuations due to the interference produced by the secondary modes described earlier. Several solutions have been proposed to cancel or to reduce to an acceptable level the intensity of the secondary modes, at least on a frequency band from $2f_{start}$ to $k \times f_{start}$ where k depends on the efficiency of the solution. Generally, k varies from 3 to 5 or even 7 with the best solutions. If we refer to FIG. 1, this means that the performances deteriorate (there are large field strength fluctuations along the cable) if $\theta_1$ exceeds 115°, 135° or 145°, with k equal to 3, 5 and 7 respectively, and with $\sqrt{\epsilon_r}=1.136$.

It must be mentioned that if $\sqrt{\epsilon_r} \cong 1.1$, the $\theta_1$ values which correspond to k equal to 3, 5 and 7 are respectively 114°, 133° and 143°; these values are close to those obtained for $\sqrt{\epsilon_r}=1.136$. Similar conclusions apply if $$\sqrt{\epsilon_r} \cong 1.2.$$

FIG. 1 also shows that $\theta_1$ raises very rapidly from 0° to 35° when f increases from $f_{start}$ to $1.1f_{start}$. This band is too narrow to be of any interest in practice and it results that prior art wide band radiating cables are generally designed to have $\theta_1$ lying between ≅35° and an angle $\theta_{max}$ ranging between 115° and 145° ($\theta_{max}$ depends on the efficiency of the solution used to cancel or attenuate the secondary modes) in the frequency bands for which they are intended. This also means that (in the best case) the direction $\theta_1$ into which the wave generated by the radiating cable propagates, lies within an angle of about 110° centred on the direction perpendicular to the cable axis.

As a consequence, prior art wide band radiating cables are designed by choosing the aperture group spacing s in order to have $\theta_1$ lying between ≅35° and $\theta_{max}$ in the frequency bands for which the cable is intended. Such cables can be used at frequencies where $\theta_1 > \theta_{max}$, but the performances deteriorate due to the interferences between the main mode and insufficiently attenuated secondary modes.

The following specific documents illustrate the state of the art referred to here above.

German Patent No. 2 812 512 describes a pattern which, with the aim of producing a periodic profile in the direction of the radiating cable axis consists of apertures of the same size and of the same shape, the density of which varies periodically along the cable. As the holder of this patent indicates, the purpose of such a pattern is to produce a periodic profile of the radiation intensity in the direction of the axis of the cable. Moreover, this document does not give the extent of the frequency band in which the secondary modes are attenuated.

United Kingdom Patent Application No. 1 481 485 describes a periodic pattern consisting of two main slots and four auxiliary slots. The auxiliary slots are arranged on either side of each of the main slots. In this device, the secondary modes appearing at the frequencies lying between $f_{start}$ and $5f_{start}$ are negligible or almost zero. Moreover, a pattern of greater size would include ten slots and, consequently, would be difficult to produce in practice, since the total length of the apertures would be such that it would weaken the mechanical strength of the outer conductor.

French Patent Application No. 2 685 549 describes a pattern including N apertures, the useful frequency band of which lies between $f_{start}$ and $N \times f_{start}$.

The patterns described in these last two documents have the drawback that the apertures are present over almost the whole length of the cable, which has the effect of reducing the mechanical strength. It is well known, in fact, that deformations of the cable or of the apertures in the outer conductor may greatly affect the performances obtained. Another drawback of these known solutions is the difficulty of producing long slanted slots with different inclinations on certain types of cable constructions.

German Patent No. 9 318 420 describes a solution which uses a corrugated outer conductor. No mention is made of the elimination of secondary modes.

European Patent No. 0765002 describes a solution for a narrow band cable which uses a periodic pattern consisting of two opposed slots elongated in the axial direction. The pattern spacing is approximately equal to one wave length in order to radiate in a direction $\theta_1$ close to 90°.

U.S. Pat. No. 6,292,071 describes a solution for a wide band coupled mode cable which uses groups of apertures separated by a spacing varying between 8 and 10 m. Such an exemplary embodiment has the drawbacks of the coupled mode cables.

International Patent Publication No. 99/17401 describes a solution for a radiated mode cable which is based on a principle similar to the one shown in FIG. 2 but in which each slanted slot is replaced by a group of circular or elongated holes.

Belgian Patent No. 1010528 describes a radiating cable operating in radial direction for a specific frequency band, which comprises an outer conductor provided with a periodic pattern of aperture groups with a spacing p equal to $$\lambda/(\sqrt{\epsilon}+1),$$

where $\lambda$ is the wavelength of the lowest frequency at which the cable operates in radiated mode and $\epsilon_r$ is the dielectric constant of the cable. The length of the periodic pattern is equal to p/2 and the number of apertures in each group ranges from 1 up to 10.

SUMMARY OF THE INVENTION

It is a feature of the present invention to provide an improved narrow band radiating cable exhibiting a low coupling loss over a frequency band of about one octave.

Another feature of the present invention is to provide an improved narrow band radiating cable exhibiting small field strength fluctuations over a frequency band of about one octave and hence will allow the attainment of low bit error rates when used for digital communications and minimizes distortions when used for analogue communications.

A further feature of the present invention is to provide a wide band radiating cable which provides a large band in which the performances are comparable to prior art wide band cables and a band the length of which is about one octave in which the cable features a lower coupling loss and smaller field strength variations.

It has indeed been found surprisingly, in accordance with the present invention, that the foregoing objectives can be reached by providing a radiating coaxial cable which includes an array of apertures, repeated at a constant spacing s, very specifically chosen in such a way that $\theta_1$ varies in the interval between about 150° and 180° in the highest frequency band the cable is intended for.

For the detailed description of the aperture patterns, the expressions "axial direction" and "transverse direction" as used in this context refer respectively to the directions parallel and perpendicular to the cable axis.

The expression "array of apertures" as used in this context refers to any periodic pattern of apertures which comprises n identical or similar single apertures, repeated along the length of the outer conductor, or which comprises n identical or similar aperture sets repeated along the length of the outer conductor whereas an aperture set may include identical or different apertures (not necessarily aligned in the axial or transverse direction, as for instance illustrated in the FIGS. 6 to 9 attached to this specification text), which collectively, for the purposes of this invention, behave as one single aperture, and which are, further in this text, referred to as "aperture sets".

This invention thus provides for radiated mode coaxial cable comprising an outer conductor provided with a periodic aperture array, comprising a plurality (n) of apertures or aperture sets, repeated along the length of said outer conductor whereas a constant spacing s separates the left end of the first aperture of one array and the left end of the first aperture of a next array, wherein each array comprises at least 10 apertures or aperture sets, whereas the (global) length L (in mm) of the apertures (or aperture sets) is larger than $(10\,D/n)^{1/2}$ where D is the diameter of the cable (in mm) and whereas the aperture spacing d is larger than 1.5w where w is width of the apertures or aperture sets, and wherein the spacing s between successive arrays is selected so that $$\lambda_{opt.1}/(\sqrt{\epsilon_r}-0.866)<s<\lambda_{opt.2}/(\sqrt{\epsilon_r}-1),$$

where $\lambda_{opt.1}$ and $\lambda_{opt.2}$ represent the upper and lower limit of the optimal wavelength range the radiated mode coaxial cable is designed for and where $\epsilon_r$ is the relative dielectric constant of the radiating cable.

The length L of apertures as used in this context applies to the case where the array includes n single apertures and is measured in the traverse direction and corresponds to the arc of circle length, whereas The "global length L of the apertures" applies to the case where the array includes n aperture sets and is defined by:

$$L=\Sigma L_i$$

where the $L_i$ is the arc of circle length, in the traverse direction, of the aperture number i in a set.

The "aperture width w" as used in this context is measured in the axial direction and corresponds to the largest width of the single aperture or the width of the widest aperture in a set.

The "aperture spacing d" as used in this context is measured in the axial direction and corresponds to the distance between the transverse axis of two successive apertures or aperture sets.

FIGS. 4-9 show how these different sizes are measured having reference to some specific exemplary embodiments of single apertures and aperture sets.

In a preferred exemplary embodiment of the invention, the aperture spacing d is more in particular equal to s/2n±20%

In still another preferred exemplary embodiment of the invention, the optimal wavelength range the radiated mode coaxial cable is designed for may most appropriately correspond to substantially one frequency octave (with $\lambda_{opt.2}=\lambda_{opt.1}/2$), whereas s is approximately equal to $3.7\lambda_{opt.1}$.

According to a further preferred feature of the invention, the array of apertures may more particularly involve a number (n) of apertures or aperture sets of at least 14.

Further exemplary embodiments and other details of the invention will become apparent from the following detailed description, having reference to the attached drawings, in which

DETAIL DESCRIPTION OF THE INVENTION

Figure 1:
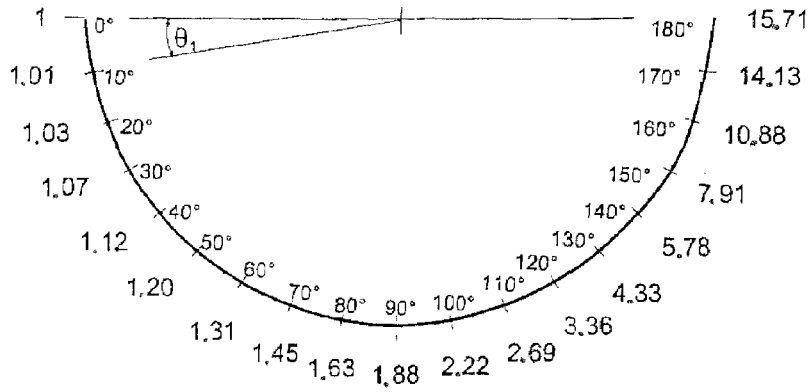
FIG. 1 is a graph of the angle $\theta_1$ versus $f/f_{start}$ calculated for $\sqrt{\epsilon_r}=1.136$.
Figure 2:
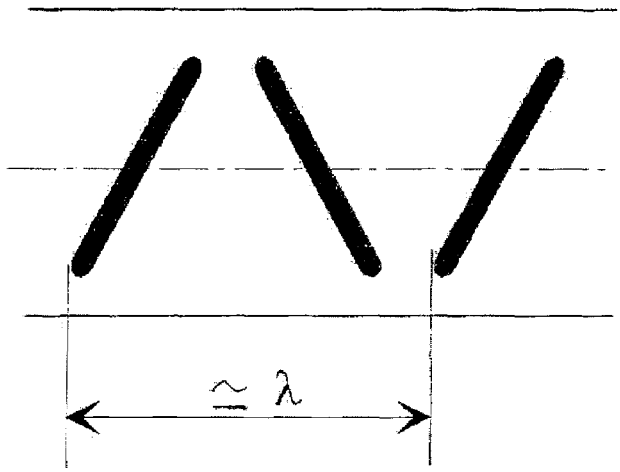
Fig. 2 PRIOR ART
FIG. 2 illustrates an aperture group spacing according to the prior art.

FIG. 1 illustrates the fact that the frequency band for $\theta_1$ varying from 150° to 180° corresponds to approximately one octave (i.e., from about $7.91f_{start}$ to $15.71f_{start}$ if $\sqrt{\epsilon_r}=1.136$).

The extent of the band where $\theta_1$ varies from 150° to 180° depends on $\sqrt{\epsilon_r}$. For the lowest $\sqrt{\epsilon_r}$ value, i.e., ≅1.1, the band is slightly larger than one octave; the ratio of the limits of this band ≅2.3. In the description of the invention, we shall assume that this band corresponds to one octave, even if it is actually slightly larger when $\sqrt{\epsilon_r}$≅1.1.

It has been discovered that, at the low end, of the above mentioned octave, (i.e., for $\theta_1$≅150°), the coupling loss is 6 dB lower than for a prior art coaxial radiating cable designed to have $\theta_1$≅90° and featuring the same longitudinal attenuation. The coupling loss decreases further when $\theta_1$ increases and the gain corresponds to 10 dB with $\theta_1$≅161°; the lowest coupling loss is obtained when $\theta_1$ is between 170° and 180°.

Furthermore, it has been found that, for $\theta_1$=150°, the field strength variations are typically less than 3 dB peak to peak when the receiving antenna is orientated for maximum response.

Designing a radiating cable which works with $\theta_1$ in the interval between about 150° and 180° requires an excellent secondary mode cancellation or attenuation up to the frequency ≅15.71$f_{start}$ with $\sqrt{\epsilon_r}$=1.136 and up to ≅21$f_{start}$ with $\sqrt{\epsilon_r}$=1.1.

A drop of the radiation intensity in the direction $\theta_1$ approaching 180°, is avoided due to the fact that the n apertures or aperture sets must preferably have a global length L which satisfies the following condition:

$$L>(10D/n)^{1/2} \tag{7}$$

where D is the diameter of the cable. In this expression, L and D are expressed in mm.

As an example, for a standard cable having a diameter of 1¼", (i.e., ≅33 mm) with an array of 12 apertures, the minimum aperture length of about 5.25 mm which corresponds to 16% of the array diameter.

A radiating cable according to the present invention can also be used at lower frequencies (which corresponds to $\theta_1$<150°) but the performances are slightly impaired (higher coupling loss and larger field strength variations compared to what is obtained with $\theta_1$=150°). Consequently, a wide band coaxial radiating cable according to the present invention provides a larger frequency band than wide band prior art cables.

Figure 3:
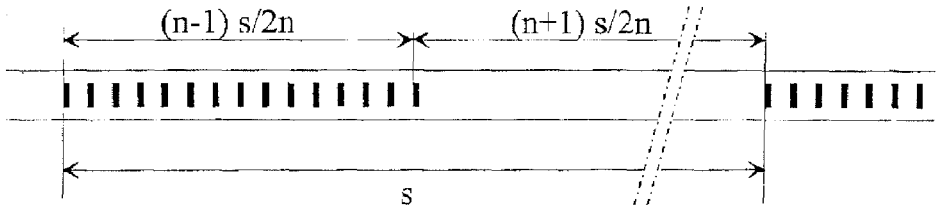
FIG. 3 illustrates one preferred exemplary embodiment of the spacing between two successive arrays of apertures according to the invention.
Figure 4:
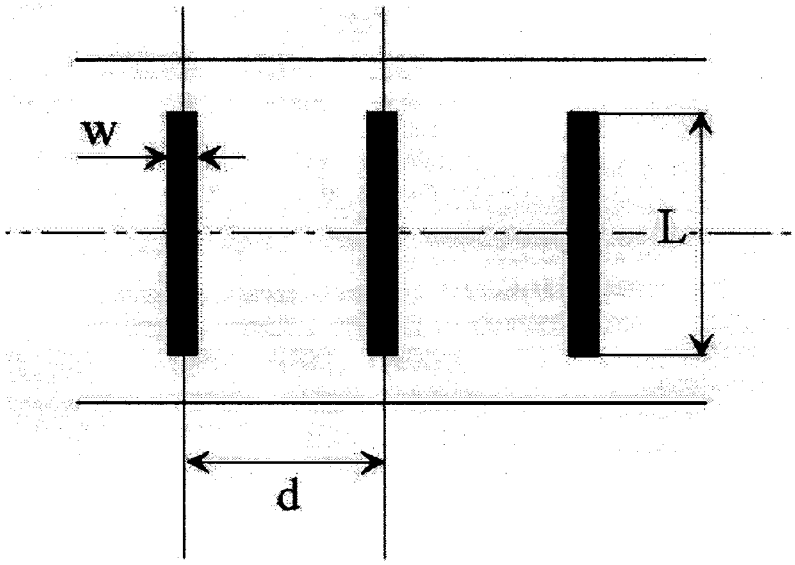
FIG. 4 illustrates one preferred exemplary embodiment of aperture arrays comprising of a single aperture in accordance with the invention.

FIG. 3 shows one of the preferred exemplary embodiments of the present invention. It includes arrays of n transverse apertures or "slots" (with n being larger than 10 and preferably equal to or larger than 14) reproduced at a constant spacing s measured between the left most end of two successive slot arrays. The slot spacing d is equal to s/2n±Δ (where Δ represents about 20% of s/2n) as shown in FIG. 4. It results that the distance between the left end of the first slot and the left end of the last slot grouping an array is equal to (n−1)s/2n as shown in FIG. 3. The array of slots is followed by a section without any slot, the length of which is equal to (n+1)s/2n if measured between the left end of the last slot of an array and the left end of the first slot of the next array as shown in FIG. 3.

The n transverse slots must have a minimum length L (in mm) equal to (10 D/n)1/2 where D is the diameter of the cable (in mm) and the slot spacing d must be larger than 1.5w where w is width of the apertures or aperture sets.

The spacing s must be chosen in order that $\theta_1$≅150° at the bottom of the octave in which the performances must be optimized; this octave is delimited by the frequencies (in MHz) $f_{opt}$ and $2f_{opt}$ which correspond respectively to the wavelengths (in the air) $\lambda_{opt}$ and $\lambda_{opt}/2$.

$\lambda_{opt}$ is linked to $f_{opt}$ by the expression $$\lambda_{opt} = \frac{300}{f_{opt}} \tag{8}$$

The condition $\theta_1$≅150° at frequency $f_{opt}$ can be written, if we consider expression (1)

$$\cos 150° \cong \frac{\lambda_{opt}}{s} - \sqrt{\varepsilon_r} \tag{9}$$

As cos 150°=−0.866 and for $\sqrt{\epsilon_r}$=1.136, we obtain the following condition:

$$s \cong \frac{\lambda_{opt}}{0{,}269} \cong 3.7\lambda_{opt} \tag{10}$$

In principle, if $\sqrt{\epsilon_r}$ is different from 1.136, the condition (10) should be recalculated. In practice however, such a difference has only a small impact; indeed, choosing s≅3.7$\lambda_{opt}$ with $\sqrt{\epsilon_r}$≅1.1 gives rise to $\theta_1$≅146° which is at less than 3% of the target value.

There is a second condition which imposes that $\theta_1$=180° at the top of the frequency band in which performances optimization is required, i.e., for $\lambda=\lambda_{opt}/2$. From FIG. 1, it is obvious that this condition is always satisfied if s is chosen according to the expression (10).

A coaxial radiating cable, according to the present invention, with a spacing s given by the expression (10) provides a low coupling loss and small field strength variations in the octave between $\lambda_{opt}$ and $\lambda_{opt}/2$.

If the optimization is required on a frequency band which is less than one octave, for example between the wavelengths $\lambda_{opt1}$ and $\lambda_{opt2}$ (with $\lambda_{opt2}>\lambda_{opt1}/2$), the condition (10) becomes $$s> \text{ or } =3.7\lambda_{opt1} \tag{11}$$

The second condition which imposes that $\theta_1$< or =180° will be satisfied if $$\cos 180° < \text{or} = \frac{\lambda_{opt2}}{s} - \sqrt{\varepsilon_r} \tag{12}$$

As cos 180°=−1, we obtain for $\sqrt{\epsilon_r}$=1.136

$$s < \text{or} = \frac{\lambda_{opt2}}{0{,}136} \cong 7.3\lambda_{opt2} \tag{13}$$

If $\sqrt{\epsilon_r}$≅1.1, this condition is:

$$s < \text{or} = \frac{\lambda_{opt2}}{0{,}1} \cong 10\lambda_{opt2} \tag{14}$$

For $\sqrt{\epsilon_r}$=1.136, the spacing s is chosen within the interval [≅3.7$\lambda_{opt1}$; ≅7.3$\lambda_{opt2}$];

for $\sqrt{\epsilon_r}$≅1.1, the spacing s is chosen within the interval [≅3.7$\lambda_{opt1}$; ≅10$\lambda_{opt2}$].

As these intervals are large, s is chosen to avoid having resonant frequencies in the frequency bands of interest.

As a first example, we consider a radiating cable optimized for the frequency band allocated to the TETRA communication standards and to Private Mobile Radio (PMR) systems. This frequency band extends from 380 to 470 MHz. The wavelengths in the air $\lambda_{opt1}$ and $\lambda_{opt2}$ are respectively equal to 79 and 64 cm. We shall assume that $\sqrt{\epsilon_r}=1.136$. To satisfy the conditions (11) and (13), the length of the pitch s is chosen within the interval [292 cm; 467 cm] and to avoid having any resonant frequencies in the bands of interest.

As an example, for a spacing where s=350 cm, $\theta_1$ varies from 155.6° to 162.6° in the frequency band from 380 to 470 MHz.

A radiating cable according to the present invention and with a spacing s chosen within the interval [292 cm; 467 cm] works also, with lower performances, at frequencies outside the 380 to 470 MHz band and can be used as wide band cable. For example, with s=350 cm, the cable operates in radiated mode, with satisfactory performances, between about 40 and 600 MHz.

As a second example, we consider a radiating cable optimized for the transmission of the TDMA IS-54, CDMA IS 95 and GSM 900 mobile communication standards the frequency band of which extends from 824 to 960 MHz. The wavelengths in the air $\lambda_{opt1}$ and $\lambda_{opt2}$ are respectively equal to 36 and 31 cm. We shall assume that $\sqrt{\epsilon_r}=1.136$. To satisfy the conditions (10) and (12), the spacing s is chosen within the interval [135 cm; 226 cm] and to avoid having resonant frequencies in the bands of interest.

A radiating cable according to the present invention and with a spacing s chosen within the interval [135 cm; 226 cm] works also, with lower performances, at frequencies outside the 870 to 960 MHz band and can be used as a wide band cable. For example with s=200 cm, the cable operates in radiated mode, with satisfactory performances, between about 70 and 1050 MHz.

As a third example, we shall consider a radiating cable optimized for the frequency band allocated to Wireless Local Area Network (WLAN) working above 5 GHz. The precise frequency band extends from 5150 to 5850 MHz. The wavelengths in air $\lambda_{opt1}$ and $\lambda_{opt2}$ are respectively equal to about 6 and 5 cm. We shall assume that $\sqrt{\epsilon_r}=1.136$. To satisfy the conditions (11) and (13), the spacing s is chosen within the interval [22 cm; 36 cm] and to avoid having resonant frequencies in the bands of interest.

As an example, for a spacing where s is equal to 32 cm, $\theta_1$ varies from 162.6° to 167.5° in the frequency band from 5150 to 5850 MHz.

A radiating cable according to the present invention and with a spacing s chosen within the interval [22 cm; 36 cm] works also, with lower performances, at frequencies outside with 5150 to 5850 MHz band and can be used as a wide band cable. For example with s=32 cm, the cable would operate in radiated mode, with satisfactory performances, between about 440 and 6500 MHz.

The rectangular slots perpendicular to the cable axis as shown in FIG. 4 is one of the preferred exemplary embodiments. The slot sizes are chosen to control the coupling loss with a minimum length L equal to $(10D/n)^{1/2}$ where D is the diameter of the cable. The slots spacing d is equal to $s/2n\pm\Delta$ and must be larger than 1.5w where w is width of the apertures or aperture sets.

Figure 5:
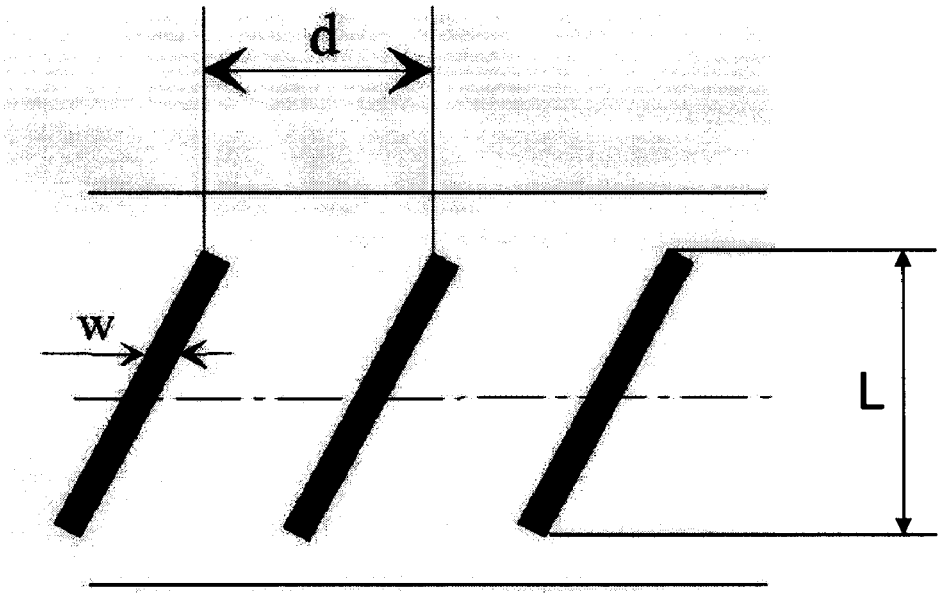
FIG. 5 illustrates one preferred exemplary embodiment of aperture arrays comprising of a single aperture in accordance with the invention.

Other exemplary embodiments allow to achieve the same effect. For example, the slot may be slanted with respect to the cable axis as shown in FIG. 5, where L is length, w is width and d is slot spacing.

The slot may also have rounded corners. The single aperture may also have an elliptical or oval shape with the main axis either perpendicular, parallel or slanted with respect to the cable axis. The aperture may also be circular.

Figure 6:
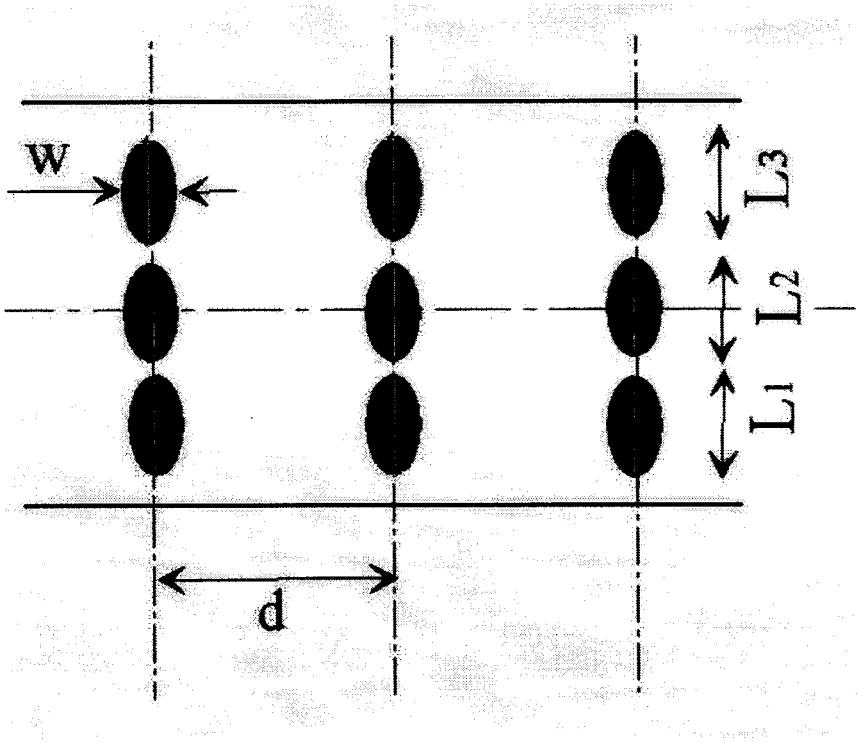
FIG. 6 illustrates one preferred exemplary embodiment of aperture arrays comprising of an aperture set in accordance with the invention.
Figure 7:
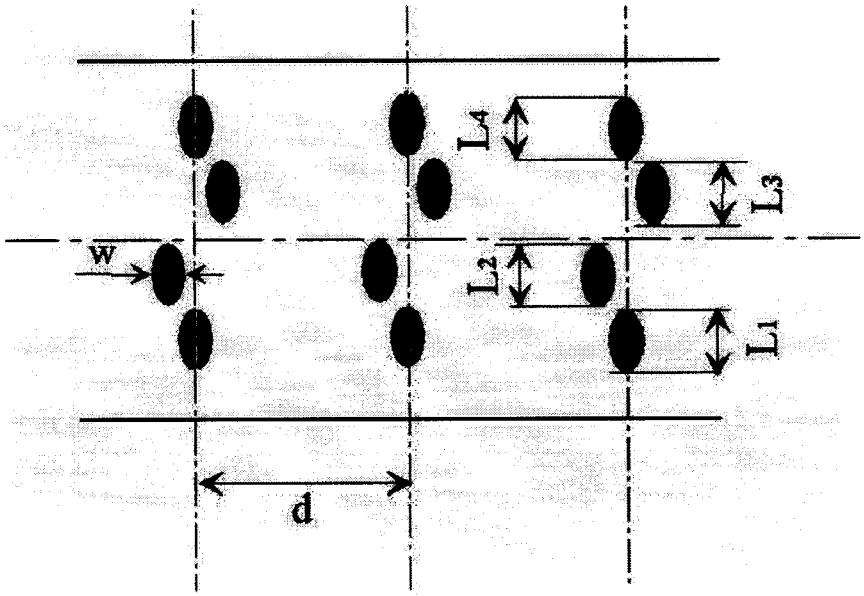
FIG. 7 illustrates one preferred exemplary embodiment of aperture arrays comprising of an aperture set in accordance with the invention.

The single aperture may also be replaced by an aperture set including a plurality of smaller identical apertures either transversally aligned, as illustrated in FIG. 6, or not aligned, as shown in FIG. 7. For FIGS. 6-9, $L_1$, $L_2$, $L_3$, and in FIG. 7, $L_4$, are the lengths of the respective apertures shown, w is the width, and d is the aperture spacing.

Figure 8:
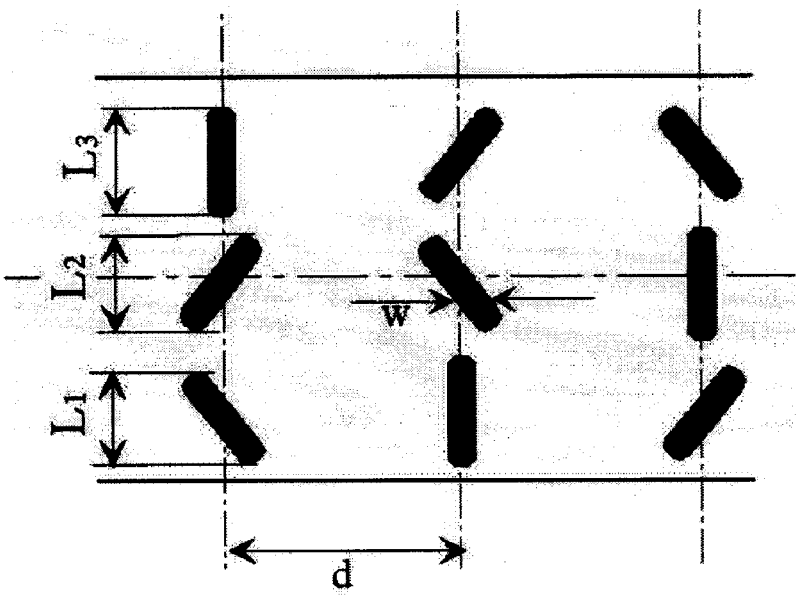
FIG. 8 illustrates one preferred exemplary embodiment of aperture arrays comprising of an aperture set in accordance with the invention.
Figure 9:
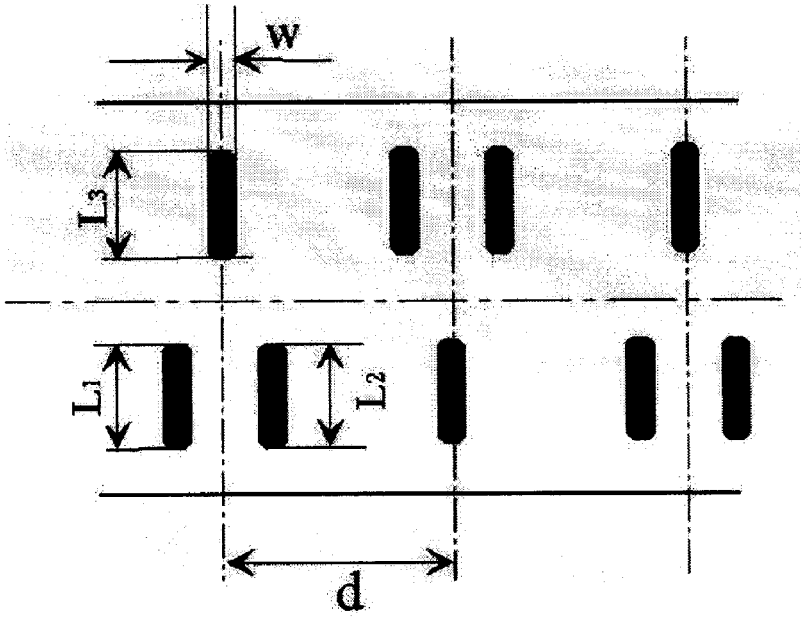
FIG. 9 illustrates one preferred exemplary embodiment of aperture arrays comprising of an aperture set in accordance with the invention.

The apertures in a set may be different and two successive sets are not necessarily identical provided that all sets feature approximately equivalent radiation properties as shown in FIGS. 8 and 9.

In the particular exemplary embodiments shown in FIGS. 6 to 9, the global length L of the apertures must be larger than $(10D/n)^{1/2}$. The aperture spacing d, equal to $s/2n\pm\Delta$, must be larger than 1.5w where w is the width of one aperture or aperture set.

All patents, applications and publications referred to herein are incorporated by reference in their entirety.

The invention claimed is:

1. A radiated mode coaxial cable, comprising: an outer conductor provided with a periodic aperture array, comprising a plurality (n) of apertures or aperture sets, repeated along the length of said outer conductor, wherein a constant spacing (s) separates a first end of the first aperture of one array of the periodic aperture array and the first end of the first aperture of a next array of the periodic aperture array wherein each array of n apertures comprises at least 10 apertures or aperture sets, wherein the (n) apertures or aperture sets have a global length L in the direction transverse to the cable axis at least equal to $(10D/n)^{1/2}$, where D is the diameter of the cable and wherein the aperture spacing (d) in between two successive apertures or aperture sets is larger than 1.5w; where w is the aperture width in the cable longitudinal axis direction and wherein the spacing (s) between successive aperture arrays is selected so that $$\lambda_{opt.1}/(\sqrt{\epsilon_r}-0.866)<s<\lambda_{opt.2}/(\sqrt{\epsilon_r}-1);$$

where $\lambda_{opt.1}$ and $\lambda_{opt.2}$ are respectively the upper and lower limits of the optimal wavelength range, the radiated mode coaxial cable is designed for, and where $\epsilon_r$ represents the relative dielectric constant of the radiating cable.

2. The radiated mode coaxial cable of claim 1, wherein the aperture spacing (d) between the two successive apertures or aperture sets is equal to $s/2n\pm20\%$.

3. The radiated mode coaxial cable of claim 1, wherein the optimal wavelength range of the radiated mode coaxial cable is designed for corresponds to substantially one octave (with $\lambda_{opt.2}=\lambda_{opt.1}/2$), whereas s is at least equal to $3.7\lambda_{opt.1}$.

4. The radiated mode coaxial cable of claim 1, wherein the periodic aperture array involves a number (n) of apertures or aperture sets of at least 14.

5. The radiated mode coaxial cable of claim 1, wherein the cable is designed for radiating at an angle $\theta_1$ of between about 150° and about 180° with respect to the longitudinal axis of the cable, where $\theta_1=\arccos\{\lambda/s-\sqrt{\epsilon_r}\}$ in which $\lambda$ is the signal wavelength (in meters) in air.

* * * * *